US006139708A

United States Patent [19]

Nonomura et al.

[11] Patent Number: 6,139,708

[45] Date of Patent: Oct. 31, 2000

[54] DIP SURFACE-TREATMENT SYSTEM AND METHOD OF DIP SURFACE-TREATMENT USING SAME

[75] Inventors: Hiromi Nonomura, Saitama; Hirokazu Sugiyama, Kawasaki; Yasuo Takamizu, Tokyo; Shigeyoshi Okada, Yokohama; Toshihiko Koike, Gunma, all of Japan

[73] Assignees: Nissan Motor Co., Ltd., Kanagawa; Taikisha Ltd., Tokyo, both of Japan

[21] Appl. No.: 09/131,344

[22] Filed: Aug. 7, 1998

[30] Foreign Application Priority Data

| | | | |
|---|---|---|---|
| Aug. 8, 1987 | [JP] | Japan | 9-215077 |
| Oct. 23, 1997 | [JP] | Japan | 9-309309 |
| Mar. 23, 1998 | [JP] | Japan | 10-074540 |

[51] Int. Cl.[7] ..... C25D 13/22

[52] U.S. Cl. ..... 204/482; 118/423; 204/471; 204/512; 204/623; 204/626; 427/430.1

[58] Field of Search ..... 205/98, 101; 204/471, 204/480, 482, 512, 623, 626; 427/430.1; 118/423

[56] References Cited

U.S. PATENT DOCUMENTS

| | | | |
|---|---|---|---|
| 3,951,775 | 4/1976 | Horton et al. | 204/622 |
| 4,568,438 | 2/1986 | Lauke | 204/479 |
| 4,663,014 | 5/1987 | Bassett et al. | 204/622 |
| 4,746,414 | 5/1988 | Carpenter et al. | 204/240 |
| 5,830,282 | 11/1998 | Olashuk | 134/10 |

FOREIGN PATENT DOCUMENTS

| | | | |
|---|---|---|---|
| 57099366 | 12/1980 | Japan | B05D 1/18 |
| 59-143097 | 2/1983 | Japan | C25D 13/22 |
| 01013328 | 7/1987 | Japan | B65G 49/02 |
| 6-272091 | 9/1994 | Japan . | |
| 6-272092 | 9/1994 | Japan . | |
| 6-280095 | 10/1994 | Japan . | |
| 8-41687 | 2/1996 | Japan . | |

*Primary Examiner*—Kathryn Gorgos
*Assistant Examiner*—W . T. Leader
*Attorney, Agent, or Firm*—McDermott, Will & Emery

[57] ABSTRACT

The invention relates to a system for treating a surface of an article with a liquid material by dipping. This system includes (a) a major tank having therein the liquid material for dipping the article thereinto; and (b) a circulatory mechanism for circulating the liquid material through the major tank. The circulatory mechanism is arranged to make a flow of the liquid material through the major tank such that the majority of the flow is in one direction that is substantially along the longitudinal direction of the major tank. Thus, contaminants and/or bubbles are not distributed over the entire major tank, but are effectively promptly removed from the major tank. The flow of the liquid material may include a first flow of the liquid material in the major tank and a second flow that is lower than the first flow in position. The first and second flows run substantially in parallel with each other, before the first and second flows reach a downstream end thereof in the major tank. The major tank may be formed at the downstream end with a wall having a special configuration such that the first and second flows separate or diverge from each other at the downstream end, and thus the flow of the liquid material through the major tank becomes very smooth.

53 Claims, 8 Drawing Sheets

DIP SURFACE-TREATMENT SYSTEM AND METHOD OF DIP SURFACE-TREATMENT USING SAME

The contents of Japanese Patent Application Nos. 9-215077, 9-309309, and 10-74540, respectively having filing dates of Aug. 8, 1997, Oct. 23, 1997, and Mar. 23, 1998, are hereby incorporated by reference.

BACKGROUND OF THE INVENTION

The present invention relates to a dip surface-treatment system, particularly to an electrodeposition coating system, and a method for treating the surface of an article (work) with a liquid material by dipping, using the system.

In general, a car body is formed thereon with a primer coating layer, a surface coating layer, and a top coating layer. The primer coating layer is usually formed by electrodeposition coating wherein a liquid coating material (primer) is applied to a car body by dip coating. Dip coating is also used in the degreasing and chemical conversion coating on the car body, prior to the formation of the primer coating layer. In such dip coating, car bodies, which are continuously transported to the dip coating site, are fully dipped in turn in a liquid material of a tank for a certain period of time. In electrodeposition coating, it is necessary to stir or circulate a liquid coating material continuously or intermittently in order to prevent the precipitation of a pigment of the liquid coating material. Once the pigment precipitates in the tank, it is very difficult to fully disperse the pigment in the liquid coating material due to a large quantity of the liquid coating material in the tank. If the pigment dispersion in the liquid coating material of electrodeposition coating is not uniform, the gloss of the primer coating may deviate from that as originally designed. This may cause an adverse effect on the top coating. In electrodeposition coating, when an article is dipped in a liquid coating material, the paint particles are attracted to the article and deposit on its surface. Upon this, hydrogen or oxygen bubbles are generated from the surface of the article. These bubbles may cause defects of the primer coating layer. Thus, it is necessary to stir or circulate the liquid coating material to remove the bubbles from the surface of the article, too. In electrodeposition coating, heat of reaction is generated when the primer coating layer is formed on an article. With this, the liquid coating material in the vicinity of the surface of the article will increase in temperature. This will lower the resistance of the primer coating layer. If the liquid coating material is allowed to stand still under this condition, the primer coating layer may become locally too thick in thickness. In order to prevent this problem, it is also necessary to stir or circulate the liquid coating material, thereby to cool down the liquid coating material of higher temperature by supplying that of lower temperature.

Prior to the pretreatment of electrodeposition coating, a car body is formed by welding panels together, and then washed several times in order to remove metal powder and other contaminants in the welding step. It may be difficult, however, to completely remove contaminants from the car body, prior to the step of electrodeposition coating. Once contaminants (e.g., metal powder) are brought into the tank of electrodeposition coating, the contaminants may deposit on the primer coating layer. Thus, it is also necessary to stir or circulate the liquid coating material in order to remove the contaminants therefrom. In fact, the liquid coating material is filtered to remove the contaminants. The stirring or circulation of the liquid coating material may be conducted to have a flow rate, for example, of about 10 cm/s. Each of Japanese Patent First Publications 6-272091, 6-272092, 6-280095 and 8-41687 discloses an electrodeposition coating system. This system has a major tank for receiving therein a liquid coating material. The major tank has an introductory region into which an article (work) is introduced, and an exit region from which the article is withdrawn. The system further has a minor tank adjacent to the exit region of the major tank. The minor tank continuously receives an overflow of the coating liquid, and then the coating liquid in the minor tank is continuously returned to the major tank. The liquid coating material of the major tank is circulated to have (1) a surface layer's flow in a direction from the introductory region towards the exit region of the major tank and (2) a bottom layer's flow in a direction from the exit region towards the introductory region. In other words, the direction of the surface layer's flow is opposite to that of the bottom layer's flow, and these flows form a so-called loop flow circulating in the major tank. It should be noted that the article passes through the major tank in a direction along the direction of the surface layer's flow of the liquid coating material.

SUMMARY OF THE INVENTION

It is therefore an object of the present invention to provide a system for treating a surface of an article with a liquid material by dipping, in which contaminants, such as metal powder and aggregates of paint particles, and/or bubbles can effectively be removed from the tank, in which the precipitation of paint particles can be prevented, and in which the local temperature increase of the liquid material can also be prevented.

It is another object of the present invention to provide a method for treating an article with a liquid material by dipping, using the system.

According to the present invention, there is provided a system for treating a surface of an article with a liquid material by dipping. This system comprising (a) a major tank having therein the liquid material for dipping the article thereinto; and (b) a circulatory mechanism for circulating the liquid material through the major tank.

According to a first aspect of the present invention, the circulatory mechanism comprises (1) a minor tank connected with the major tank and (2) means for sucking the liquid material out of the major tank. The minor tank receives an overflow of the liquid material from the major tank. Furthermore, according to the first aspect of the present invention, the circulatory mechanism is arranged to make a flow of the liquid material through the major tank such that a contaminant, which has been introduced into the major tank by the article, is allowed to flow from the major tank to the minor tank by the overflow of the liquid material and that another contaminant, which has been introduced into the major tank by the article, is sucked out of the major tank by the sucking means. The sucking means of the invention may be a sucking port of a fluid conduit.

According to a second aspect of the present invention, the circulatory mechanism is arranged to make a flow of the liquid material through the major tank such that a majority of the flow of the liquid material is in one direction that is substantially along a longitudinal direction of the major tank.

Thus, according to the present invention, contaminants, which have been introduced into the major tank by the article, and/or bubbles are not distributed over the entire major tank, but are effectively promptly removed from the major tank, since the circulatory mechanism of the system is arranged to make the above-mentioned special flow of the liquid material. In fact, contaminants and/or bubbles do not remain in a central region of the tank for a long time, since a majority of the flow of the liquid material is in the above-mentioned one direction. Furthermore, according to the present invention, it becomes possible to prevent precipitation of paint particles and the local temperature increase of the liquid material due to the abovementioned arrangement of the circulatory mechanism.

According to the present invention, there is provided a s method for treating a surface of an article with a liquid material by dipping, using the above-mentioned system. This method comprises the step of (a) making the above-mentioned flow of the liquid material through the major tank by arranging the circulatory mechanism, while the article is dipped in the liquid material to treat its surface with the liquid material.

According to the present invention, the above-mentioned flow of the liquid material may comprise a first flow of the liquid material in the major tank and a second flow that is lower than the first flow in position. The first and second flows run substantially in parallel with each other, before the first and second flows reach a downstream end of the major tank. The major tank may be formed at the downstream end with a wall having a special configuration such that the first and second flows separate or diverge from each other at the downstream end and are allowed to cause the overflow and move towards the sucking means, respectively. With this, the first and second flows do not interfere with each other, and thus the flow of the liquid material through the major tank becomes very smooth. Therefore, contaminants, which have been introduced into the major tank, and/or bubbles are allowed to effectively promptly flow from the major tank to the minor tank by the overflow of the liquid material and/or be sucked out of the major tank by the sucking means. Furthermore, it becomes possible to substantially reduce the formation of bubbles that may be caused by the interference of the first and second flows with each other. Thus, it becomes possible to substantially decrease the occurrence of defects (e.g., clusters of the paint particles), for example, in a primer coating layer.

In addition to the above-mentioned step (a), the method according to the invention may comprise the steps of (b) making the first and second flows run substantially in parallel with each other before the first and second flows reach a downstream end thereof in the major tank; and (c) separating the first and second flows from each other at the downstream end by a wall of the major tank at the downstream end, thereby to respectively allow the first and second flows to cause the overflow and to move towards the sucking means.

DESCRIPTION OF THE PREFERRED EMBODIMENTS

It is needless to say that the present invention is not limited to an electrodeposition coating system, but may include other systems for treating a surface of an article (work) with a liquid material by dipping. For example, it may include a chemical conversion coating system for forming a chemical conversion coating layer on a car body, prior to the formation of an electrodeposition coating layer.

Figure 1:
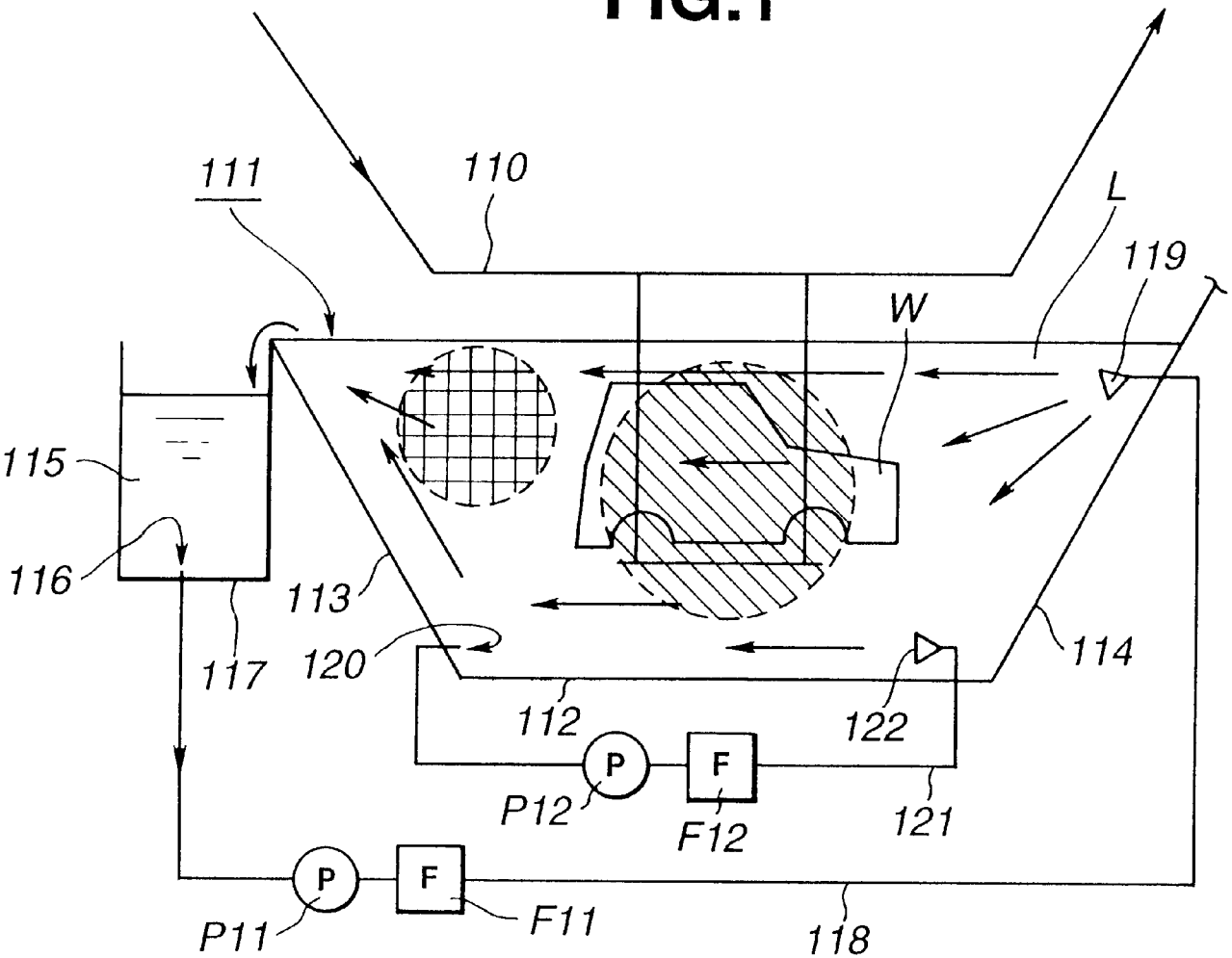
FIG. 1 is a schematic sectional view showing an electrodeposition coating system according to a first embodiment of the present invention.

As is seen from FIG. 1, there is provided an electrodeposition coating system according to the first embodiment of the present invention. In the following, this electrodeposition coating system will be described in detail. The system comprises a carrier (conveyer) 110 for carrying a work W (car body) to the electrodeposition coating's site, while the work is hung on the carrier 110. The system further comprises a major tank (electrodeposition tank) 111 that is disposed under the carrier 110. The major tank 111 is elongated vessel-like in shape and has (1) a horizontal bottom wall 112, (2) an inclined back wall 113 on the side of an introductory region of the major tank 111, into which region the work is introduced, (3) an inclined front wall 114 on the side of an exit region of the major tank 111, from which region the work is withdrawn, and (4) left and right side walls (not shown). The major tank 111 has no deck on its top and receives therein a liquid material L for dipping the work therein. The system further comprises a circulatory mechanism for circulating or stirring the liquid material through the major tank 111. The circulatory mechanism comprises a minor tank (overflow tank) 115 that is adjacent to the introductory region of the major tank 111. The minor tank 115 receives an overflow of the liquid material, which has passed over the top of the back wall 113, from the major tank 111. This overflow is caused by the special circulation of the liquid material of the invention to make a flow of the liquid material through the major tank 111 in a direction from the exit region to the introductory region of the major tank, as illustrated by arrows in FIG. 1. It should be noted that the majority of this flow of the liquid material is made by the special arrangement of the circulatory mechanism to be in one direction that is substantially along the longitudinal direction of the major tank 111. The one direction is opposite to a direction along which the work passes through the major tank 111, as illustrated. The liquid material of the minor tank 115 is continuously returned to the exit region of the major tank 111 in order to make the above-mentioned flow towards the introductory region. In fact, the liquid material is sucked out of the minor tank 115 through a sucking (viz., suction) port 116 provided on a bottom wall 117 of the minor tank 115. The liquid material is allowed to go through a fluid conduit 118 from the sucking port 116 to a discharge port 119 for discharging the liquid material into the major tank 111. The discharge port 119 is provided at an upper part of the front wall 114 of the major tank 111 and is directed towards the introductory region of the major tank 111. In the middle of the fluid conduit 118, there are provided (1) a drive device P11 for sucking the liquid material through the sucking port 116 and driving the liquid material to go through the fluid conduit 118 and (2) a filter F11 for filtering contaminants, such as metal powder and aggregates of paint particles, out of the liquid material. Thus, the liquid material, which has been filtered by the filter F11, is discharged from the discharge port 119 by the force of the drive device P11. According to need, it is optional to provide a temperature regulator (not shown) for regulating the temperature of the liquid material, in the middle of the fluid conduit 118. The circulatory mechanism further comprises a sucking (viz., suction) port 120 for sucking the liquid material out of the major tank 111. The sucking port 120 is provided at a base portion of the back wall 113 of the major tank 111 and is directed towards the exit region of the major tank 111 in order to make the abovementioned flow. The liquid material is allowed to go through a fluid conduit 121 from the sucking port 120 to a discharge port 122 for discharging the liquid material into the major tank 111. The discharge port 122 is provided at a bottom portion of the major tank 111 and is directed towards the introductory region of the major tank 111 to make the above-mentioned flow of the liquid material. In the middle of the fluid conduit 121, there are provided a drive device P12 and a filter F12, which have the same respective functions as those of the drive device P11 and the filter F11. Similar to the above, it is optional to provide a temperature regulator in the middle of the fluid conduit 121. By the provision of the above-mentioned circulatory mechanism, the majority of the flow of the liquid material, particularly in a central region between the introductory and exit regions of the major tank 111, is in one direction that is substantially along the longitudinal direction of the major tank 111, as illustrated in FIG. 1. As a result of this, contaminants, which have been introduced into the introductory region (see a meshed circle in FIG. 1) of the main tank 111 by the work, are allowed to flow promptly into the minor tank 115, together with an overflow of the liquid material. In other words, it becomes possible to prevent the distribution of the contaminants over the entire major tank 111. Even if some of the contaminants precipitate in the introductory region of the major tank 111, they are promptly sucked out of the major tank 111 through the sucking port 120. In FIG. 1, a central portion of the major tank between the introductory and exit regions is schematically represented by a circle having therein oblique lines.

In electrodeposition coating, the paint particles of the liquid material are suspended in an aqueous solution. During the electrodeposition coating, the paint particles are given an electrostatic charge by applying a dc voltage between the electrode and the work. As the electrically conductive work enters and passes through the major tank, the paint particles are attracted to it and deposit on the surface, creating a uniform, thin coating. When the coating reaches a desired thickness, no more paint is deposited. The work is then removed from the major tank, rinsed with water, and baked at a time and temperature that depends on the particular type of paint.

In the invention, the shape and size of the major tank is decided suitably, depending on the particular type of work, so as to make it possible to maintain a sufficient distance between the work and the electrode and sufficiently stir or circulate the liquid material through the major tank. For example, in case that the work, such as a car body, passes through the major tank for electrodeposition, it is preferable that the major tank has an elongate vessel-like shape, as shown in FIG. 1, such that the distance between the work and the electrode is maintained sufficiently and that the circulation of the liquid material becomes enough. The shape of the major tank may have various modifications, as will be exemplified hereinafter in other embodiments of the invention.

In the invention, the surface of the liquid material in the major tank may be maintained at a constant level by continuously allowing the liquid material of the major tank to overflow into the minor tank which is adjacent to the major tank. With this, it becomes possible to promptly remove contaminants, such as bubbles, metal powder and aggregates of paint powder, from the major tank. In the invention, as shown in FIG. 1, it is preferable to dispose the minor tank at a position adjacent to the introductory region of the major tank in order to promptly remove contaminants that have been introduced into the introductory region by the work. In this case, a weir for allowing the liquid material to overflow from the major tank into the minor tank may be formed on the upper end of the back wall 113. The weir may be one capable of adjusting its height, and thus it is optional to adjust the flow rate of the liquid material by adjusting the height of the weir. Furthermore, it is optional to form several weirs, along the side walls of the major tank, to the extent of not having disturbance of the liquid material's flow. In this case, overflows from these weirs may be allowed to flow into the minor tank, using fluid conduits or the like.

In the invention, as will be described in detail hereinafter, it is optional to provide another minor tank (overflow tank) at a position adjacent to the exit region of the major tank, in order to collect an excess of the liquid material, which is taken out of the major tank by the withdrawal of the work. The liquid material collected in the another minor tank may be filtered and then returned to the major tank.

In the invention, the circulatory mechanism may have only one minor tank adjacent to the exit region of the major tank. In this case, it is necessary to arrange the circulatory mechanism to make a flow of the liquid material from the introductory region to the exit region, and this means that a minor tank is adjacent to the downstream end of the flow in the major tank. Thus, the direction of the flow is the same as that of the movement of the work. In this case, it is particularly preferable to adjust the speed of the flow within a range of 10–25 cm/s relative to the work moving in the major tank. With this, contaminants, which have been brought into the introductory region of the major tank by the work, are allowed to flow straight towards the exit region, and then into the minor tank by the overflow of the liquid material and/or sucked out of the major tank through a sucking port (see FIG. 5). In case that the direction of the liquid material's flow in the major tank is the same as that of the movement of the work, it is necessary to provide a drive device (e.g., pump) having a greater driving capacity, as compared with a case that the direction the liquid materials flow is opposite to that of the movement of the work.

In the invention, as shown in FIG. 1, it is preferable to provide a sucking port with each of the major and minor tanks. The sucking port of the major tank may be omitted in the invention, but it is useful for sucking precipitated contaminants out of the major tank. In the invention, the position of the sucking port in the minor tank is not particularly limited. It is preferable to provide a sucking port at a middle portion of the bottom of the minor tank in order to prevent precipitation of contaminants at the corners of the bottom thereof. Even if contaminants precipitate on the bottom of the minor tank, they may be taken out of the minor tank at certain intervals of time.

Alternatively, the liquid material of the minor tank may be stirred continuously or intermittently by a mechanical stirrer or the like to disperse contaminants in the minor tank and then the dispersed contaminants may be sucked out of the minor tank through the sucking port. In the invention, the position of the sucking port of the major tank is not particularly limited so long as the liquid material is sucked through the sucking port to make a flow of the liquid material in one direction that is substantially along the longitudinal direction of the major tank. In the invention, the manner of forming the sucking port on the major tank is not particularly limited. For example, as shown in FIG. 1, an open end portion of the fluid conduit may be inserted into the major tank through a hole of the inclined front or back wall or the bottom wall of the major tank. Alternatively, a plurality of holes may be formed through the inclined front or back wall and/or the bottom wall of the major tank, and these holes, serving as sucking ports, may be connected to a plurality of branches of the fluid conduit. In other words, the branches of the fluid conduit are not inserted into the major tank, and this is preferable to the former case in which the open end portion of the fluid conduit is inserted into the major tank. Furthermore, the sucking port is equipped with a sucking rate adjustment mechanism such as valve.

In the invention, the arrangement of the discharge port(s) for discharging the liquid material into the major tank is not particularly limited, so long as the liquid material is discharged therefrom to make a flow of the liquid material in one direction that is substantially along the longitudinal direction of the major tank. It is preferable to put a suitable nozzle on the discharge port in order to distribute the liquid material over the major tank. For example, as shown by arrows in FIG. 1, it is preferable to use a nozzle for discharging the liquid material at a wide angle. Furthermore, the nozzle of the discharge port may be of a type, of which discharge angle is adjustable, depending on the condition of the work or the flow of the liquid material. In the invention, the discharge port(s) may be positioned in the major tank, as shown in FIG. 1. Alternatively, at least one hole may be formed through the inclined front or back wall and/or the bottom wall of the major tank, and the at least one hole, serving as a discharge port, may be connected to the fluid conduit. In this case, the fluid conduit is not inserted into the major tank. Furthermore, the discharge port may be equipped with a discharge rate adjustment mechanism, as will be exemplified hereinafter.

In the invention, the drive device of the circulatory mechanism for driving the liquid material to go through the fluid conduit may be adjusted to have a flow rate of 2–3 m/s in is the fluid conduit in order to prevent precipitation of paint particles in the fluid conduit. In fact, the drive device is not particularly limited, and it is preferable to use a drive device to make the flow speed of the liquid material relative to the work to be within 10–25 cm/s. If the relative flow speed is slower than 10 cm/s, contaminants may precipitate on the work or the bottom surface of the major tank. Furthermore, the liquid material surrounding the work may not be cooled down sufficiently. If the relative flow speed is faster than 25 cm/s, advantages of circulating the liquid material through the major tank may not increase further as compared with a case that it is within a range of 10–25 m/s. Furthermore, the flow of the liquid material may be disturbed. Examples of the drive device are centrifugal pumps, such as volute pump, turbine pump, sand pump, chemi-pump, slurry pump, vertical pump and propeller pump; reciprocating pumps, such as direct acting pump, plunger pump, Milton-Roy pump and diaphragm pump; and rotary pumps such as gear pump, partition pump, screw pump and Wesko pump. In case that the drive device is disposed in an outside of the major tank, as shown in FIG. 1, the drive device may be a transverse type centrifugal pump.

In the invention, the filter, which is provided in the middle of the fluid conduit, is used for continuously filtering contaminants out of the liquid material. Thus, the filtered liquid material is discharged into the major tank. The filter is not particularly limited to a particular type. Examples of the filter are rigid-body type filters, such as a metal filter and a cylindrical member having a wire wound round it, porous filters made of ceramics, sintered metals, porous plastics and membranes, woven fabric type filters made of natural and synthetic fiber woven fabrics and metal wire, cartridge type filters having bobbin cartridge and the like, and fibrous filters made of nonwoven fabric, fibrous sheet and mat. Of these, it is preferable to use a metal wire type filter having a steel plate casing in which two cylinders, each being made of a stainless steel metal wire of about 50–100 meshes, are encased, or a cartridge type filter having a cartridge of a particle size of about 50–75 μm, in view of the size of contaminants to be filtered and the filter's durability, chemical resistance and the like. As mentioned above, it is optional to install a temperature regulator in the middle of the fluid conduit and/or on the surroundings of the major tank, for maintaining the temperature of the liquid material in the major tank within a constant range. Furthermore, it is optional to install a flow rate regulatory valve in the middle of the fluid conduit.

Electrodeposition coating systems according to the second to seventh embodiments of the present invention are described in detail as follows. Since these systems are similar in construction to the above-mentioned system according to the first embodiment, the following description will be directed to only the parts, constructions and functions that are different from those of the system according to the first embodiment.

Figure 2:
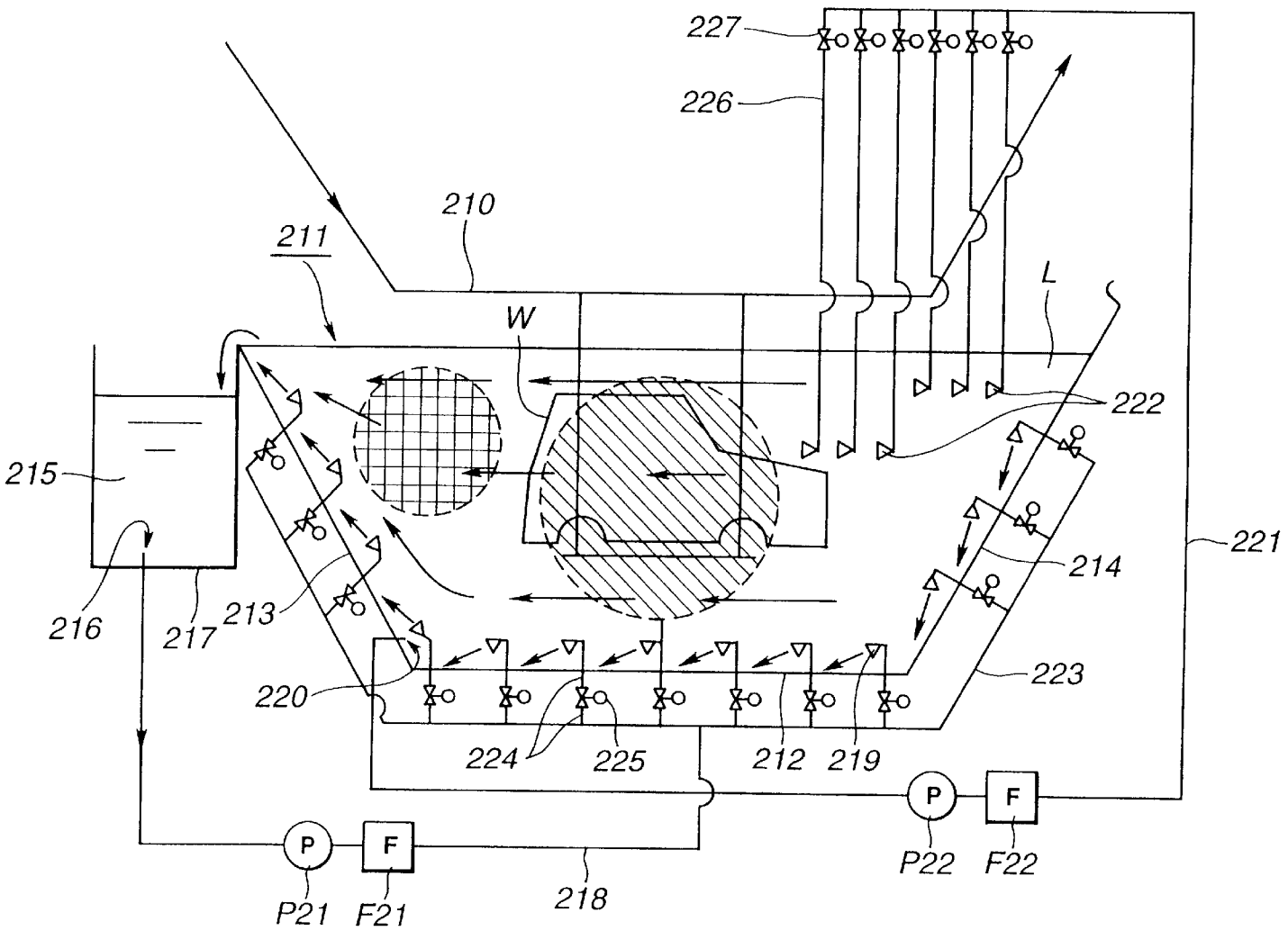
FIGS. 2–5 and 7–8 are views similar to FIG. 1, but showing those according to second to seventh embodiments of the present invention.

The electrodeposition coating system according to the second embodiment of the present invention will be described as follows. As is seen from FIG. 2, parts corresponding to those of the first embodiment are denoted by the same numerals or symbols as those of the first embodiment, except in that "2" is used in the hundred's or ten's place, in place of "1". For example, the major tank is represented by a numeral of 211, in place of 111, and the drive device for sucking the liquid material out of a minor tank 215 is represented by a symbol of P21, in place of P11. The fluid conduit 218 connected with the minor tank 215 has a major branch 223. This major branch 223 has a plurality of minor branches 224, each having a discharge port 219 and a discharge rate regulating valve 225 for regulating the discharge rate of the discharge port 219. It is optional to directly form a flow rate regulator on each discharge port 219.

The intervals of the minor branches 224 in a transverse direction, which is perpendicular to the longitudinal direction of the major tank 211, may be of 250–350 mm. The discharge ports 219 are disposed at certain intervals therebetween (e.g., 500–800 mm) in a direction along the front inclined wall 214, the bottom wall 212 and the back inclined wall 213 and are directed towards certain respective directions, as exemplarily shown in FIG. 2, such that the majority of the flow of the liquid material through the major tank 211 is in one direction that is substantially along the longitudinal direction of the major tank 211. Furthermore, it becomes possible to prevent the precipitation of contaminants on the bottom, front and/or back walls 212, 214, 213. Although not shown in the drawings, the discharge ports 219 may be disposed along the side walls of the major tank 211, too. Furthermore, the fluid conduit 221 for sucking the liquid material out of the major tank 211 through the sucking port 220 has a plurality of branches 226, each having a discharge port 222 and a discharge rate regulating valve 227 for regulating the discharge rate of the discharge port 222. The discharge ports 222 are disposed at certain intervals therebetween in the exit region of the major tank 211 so as not to interfere with the movement of the work and are directed towards the introductory region, such that the majority of the flow of the liquid material through the major tank 211 is in the above-mentioned one direction. It is optional to directly form a flow rate regulator on each discharge port 222. The position of the work in the major tank during the electrodeposition coating can be detected, and, based on this information, each discharge rate valve 225 or 227 can be opened or closed at a good timing and can be adjusted to have an appropriate flow rate and flow speed of the liquid material.

Figure 3:
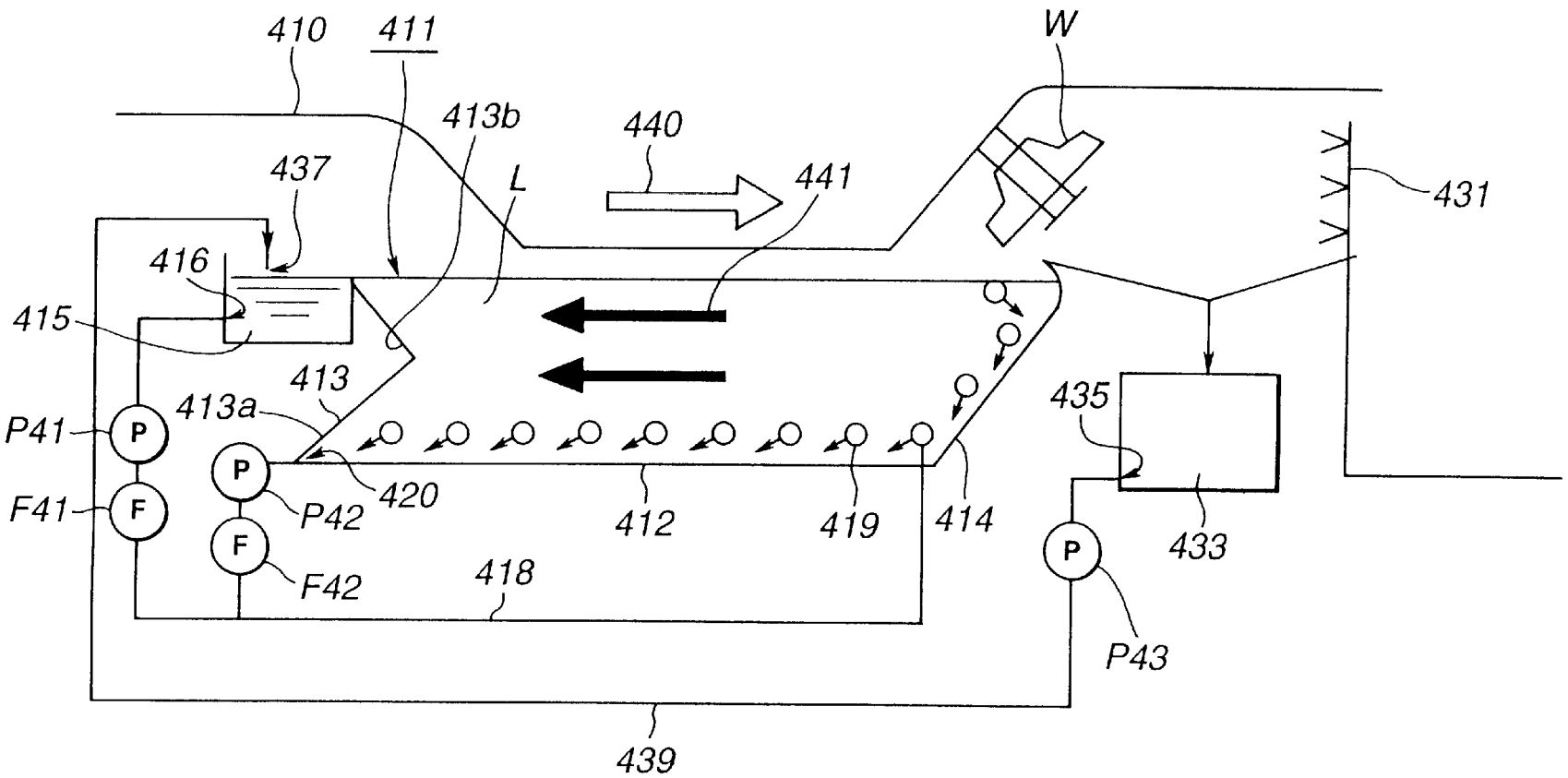
Figure 4:
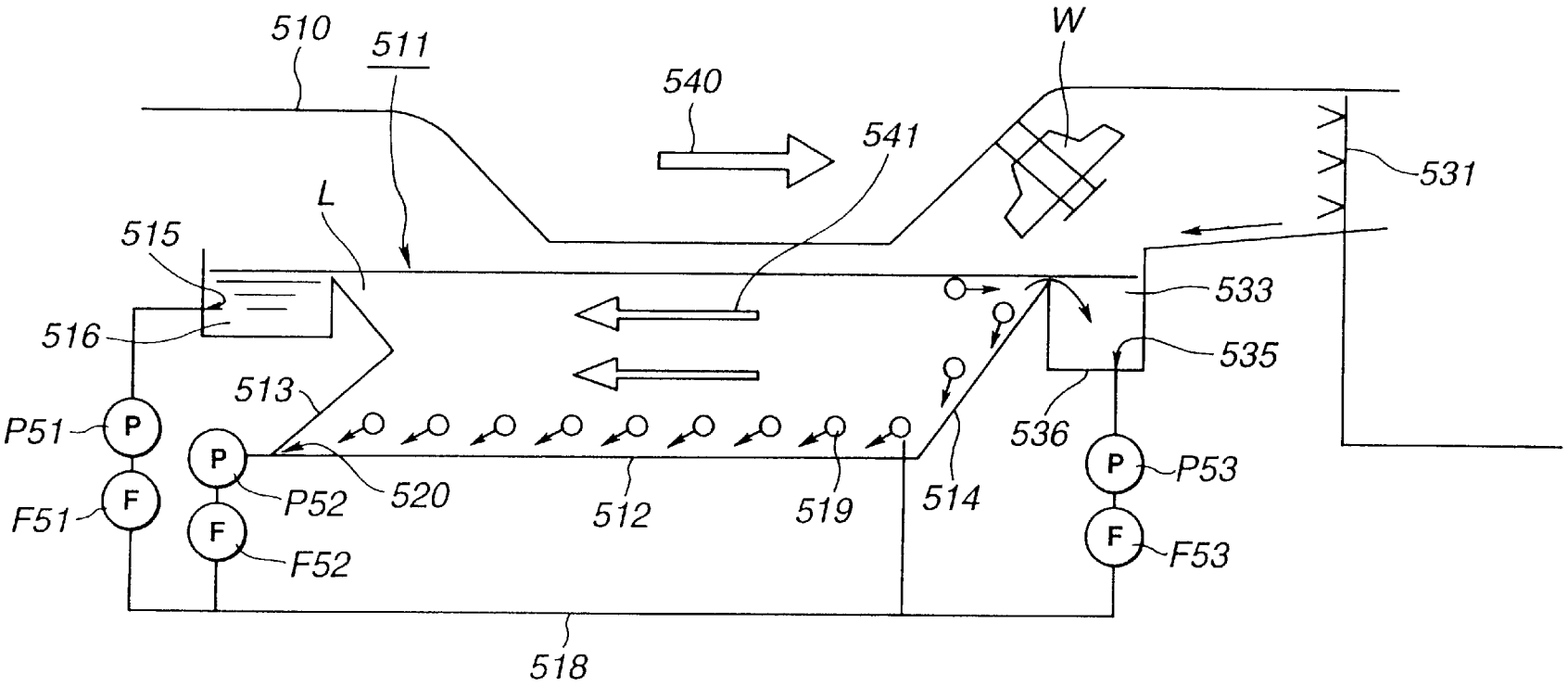

The electrodeposition coating system according to the third embodiment of the present invention will be described as follows. This system is a slight modification of that of the second embodiment, and thus the same descriptions as those of the second embodiment will not be repeated in the following. As is seen from FIG. 3, parts corresponding to those of the second embodiment are denoted by the same numerals or symbols as those of the second embodiment, except in that "4" is used in the hundred's or ten's place, in place of "2". A major tank 411 is slightly different in construction from that of the first embodiment of the invention. In fact, the major tank 411 has a back wall 413 that is a combination of a lower wall portion 413*a* and an upper wall portion 413*b* extending towards a minor tank 415. Since the lower wall portion 413*a* overhang the bottom wall 412, contaminants that have precipitated in the major tank 411 may be more efficiently promptly removed from the major tank 411 through a sucking port 420, as compared with the first embodiment. Furthermore, a front inclined wall 414 of the major tank 411 has a bent upper end portion, as shown in FIG. 3, to prevent as much as possible an overflow caused by the withdrawal of the work from the major tank 411. There is provided another minor tank (recovery tank) 433, which is disposed close to the exit region of the major tank 411, for receiving the liquid material that dripped from the work before a rinsing step and the liquid material that was rinsed in the rinsing step out of the work with water by a rinsing device 431 after the liquid material was applied to the article in the major tank. Although not shown in the drawings, it is optional to subject the liquid material that dripped from the work and the liquid material that was rinsed out of the work, to ultrafiltration and/or reverse osmosis treatment. The liquid material of the another minor tank is continuously sucked through a sucking port 435 by a drive device (pump) P43, then allowed to go through a fluid conduit 439 by the drive device P43, and then discharged from a discharge port 437 to the minor tank 415. According to need, it is optional to install a liquid material temperature regulator in the middle of the fluid conduit 439. As schematically shown in FIG. 3, it is preferable to make a slope, extending from the upper end of the front wall 414 of the major tank 411, and another slope, extending from a site of the rinsing device 431, for allowing the liquid material to smoothly flow to the another minor tank 433. The liquid material of the major tank is continuously sucked from a sucking port 420 by a drive device P42, then allowed to go through a fluid conduit 418, and then discharged from a plurality of discharge ports 419 that are connected to the fluid conduit 418 and are directed to suitable directions to make flows of the liquid material, as shown in FIG. 3. Similarly, the liquid material of the minor tank 415 is sucked from a sucking port 416 by a drive device P41, then allowed to go through the fluid conduit 418, and then discharged from the discharge ports 419. There are provided filters P41 and F42 in the middle of the fluid conduit 418 for removing contaminants from the liquid material. The direction of the movement of the work in the major tank is represented by an arrow 440, and the direction of the majority of the flow of the liquid material in the major tank is represented by arrows 441, The electrodeposition coating system according to the fourth embodiment of the present invention will be described as follows. This system is a slight modification of that of the third embodiment, and thus the same descriptions as those of the third embodiment will not be repeated in the following. As is seen from FIG. 4, parts corresponding to those of the third embodiment are denoted by the same numerals or symbols as those of the third embodiment, except in that "5" is used in the hundred's or ten's place, in place of "4". A major tank 511 is slightly different in construction from that of the third embodiment of the invention. In fact, a front inclined wall 514 has a straight upper end portion, which allows the liquid material to overflow over the upper end portion of the front wall 514 into another minor tank 533. For this purpose, the another minor tank 533 is adjacent to the exit region of the major tank 511. Furthermore, the another minor tank 538 receives the liquid material that dripped from the work before a rinsing step and the liquid material that was rinsed in the rinsing step out of the work with water by a rinsing device 531, using a slope, after the liquid material was applied to the article in the major tank. The liquid material of the another minor tank 533 is continuously sucked from a sucking port 535 by a drive device (pump) P53, then allowed to go through a fluid conduit 518 by the drive device P53, and then discharged from discharge ports 519. In other words, the fluid conduit 518 from the another minor tank 533 to the discharge ports 619 is a shortcut route for returning the liquid material from the another minor tank 533 to the discharge ports 519, as compared with a route of the third embodiment for returning the liquid material from the another tank 433 to the discharge ports 419. Thus, the electrodeposition coating system according to the fourth embodiment has a simpler structure than that of the third embodiment. According to need, it is optional to provide at least one temperature regulator for regulating the liquid material's temperature, in the middle of the fluid conduit 518. Similar to the third embodiment, the direction of the movement of the work in the major tank is represented by an arrow 540, and the direction of the majority of the flow of the liquid material in the major tank is represented by arrows 541. As shown in FIG. 4, the discharge port 519, which is close to the upper end of the front wall 514, may be arranged to allow the liquid material therefrom to flow in a direction towards the upper end of the front wall 514, and this direction is opposite to the direction of the majority of the flow of the liquid material. Thus, it becomes possible to make an overflow over the upper end of the front wall 514 into the another minor tank 533, thereby to prevent stagnation of the liquid material at a position close to the upper end of the front wall 514 and thus remove contaminants (e.g., bubbles) from the major tank.

Figure 5:
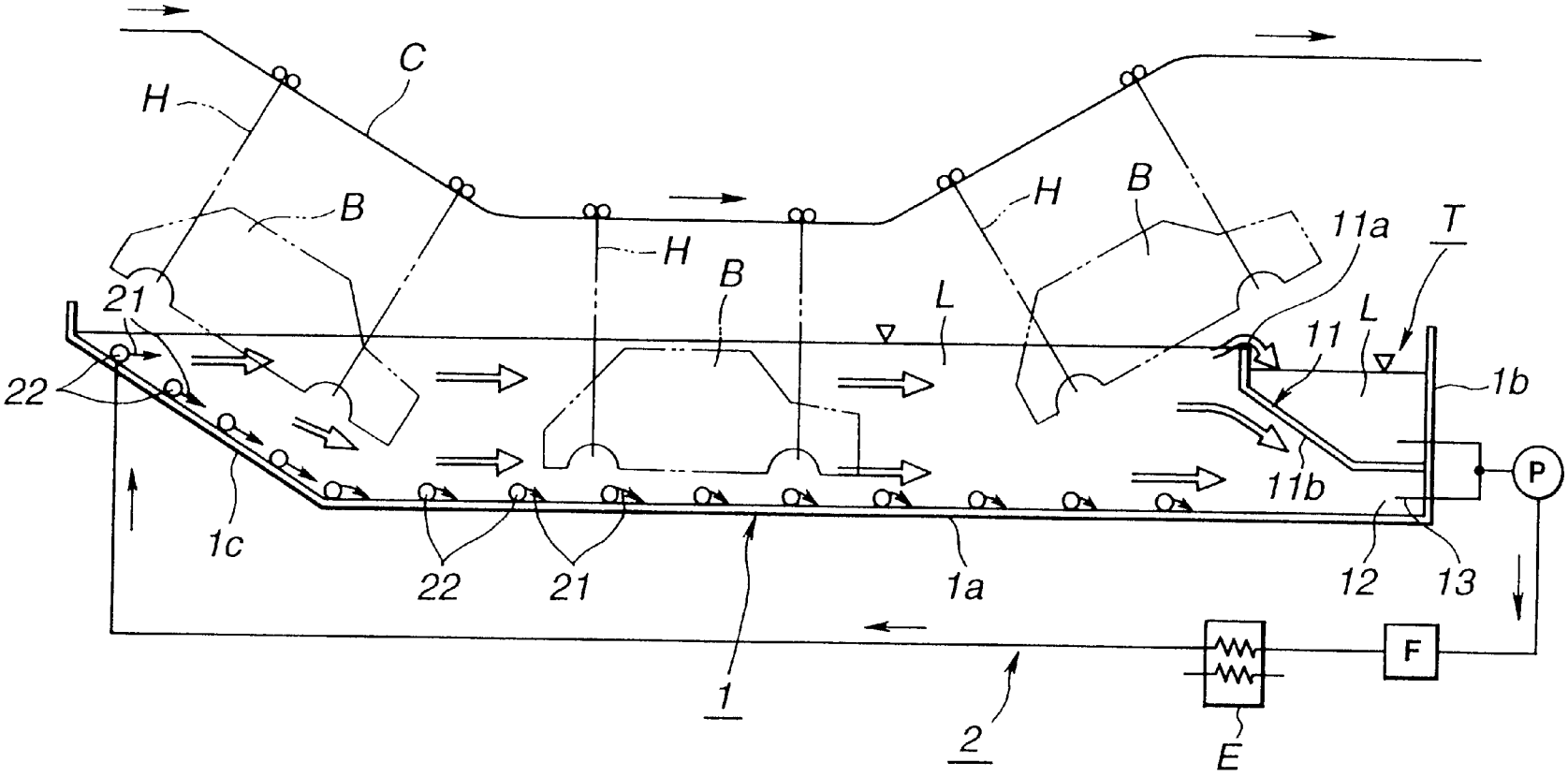
Figure 6:
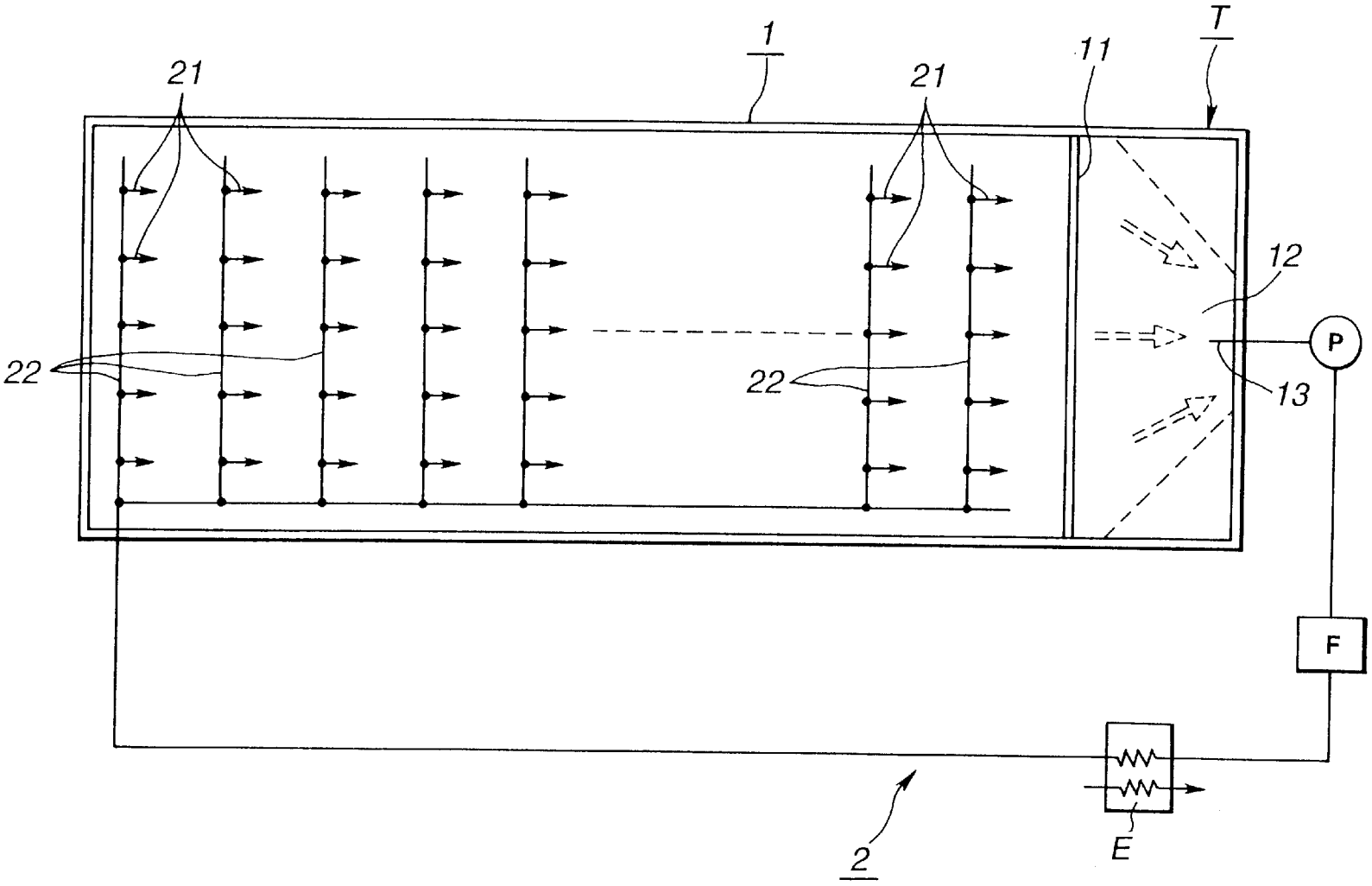
FIG. 6 is a schematic plan view showing the electrodeposition coating system of FIG. 5.

As is seen from FIGS. 5–6, there is provided an electrodeposition coating system according to the fifth embodiment of the present invention. In the following, this electrodeposition coating system will be described in detail. This system comprises a major tank (electrodeposition tank) 1 that is elongated vessel-like in shape and receives therein a liquid material (electrodeposition coating liquid) L. A work (car body) B is transported at a constant speed by an overhead conveyer C, while the work is hanged on a hanger H supported on the conveyer. During electrodeposition coating, as shown in FIG. 5, the car body is introduced at an angle of about 20–40 degrees into an introductory region of the major tank 1, then is moved in the major tank 1 while the car body is fully dipped in the liquid material, and then is withdrawn at an angle of about 20–40 degrees from an exit region of the major tank 1. It should be noted, however, that the present invention may also be applied to a half dip in which an article is partly dipped in a liquid material. The longitudinal length of the major tank 1 is such that the car body is fully immersed in the liquid material for at least three minutes. During electrodeposition coating, the paint particles of the liquid material are given an electrostatic charge by applying a dc voltage (e.g., about 300 V) between the work and an electrode (not shown) disposed on a side or bottom wall of the major tank. With this, the paint particles deposit on the surface of the work, creating a uniform, thin coating. The major tank 1 comprises a bottom wall 1*a,* a vertical front wall 1*b,* an inclined back wall 1*c,* and left and right side walls (not shown). The major tank 1 further comprises a partition wall 11, and thus there is provided a minor tank (overflow tank) T as defined by the partition wall 11 and the front wall 1*b*. The minor tank T receives an overflow of the liquid material from the major tank 1. The partition wall 11 has an inclined surface 11*b*. As stated above, the first flow (e.g., surface layer's flow) and the second flow (e.g., underlayer's flow) of the liquid material, which run substantially parallel with each other before these flows reach a downstream end of these flows in the major tank 1, smoothly separate or diverge from each other by the inclined surface 11*b* of the partition wall 11 at the downstream end and are allowed to cause the overflow and move towards a narrowed portion 12 (see FIG. 6) of the major tank 1 and a sucking port 13, as schematically shown by arrows of FIG. 5. In other words, the inclined surface 11*b* of the partition wall 11 has an inclination such that the second flow is made to move towards the sucking port 13. As shown in FIG. 6, the major tank 1 is funneled at the downstream end of the major tank 1 to have the above-mentioned narrowed portion 12 such that the flow of the liquid material, except the first flow, converges substantially at the sucking port 13. Due to this funneling, the second flow is allowed to flow smoothly towards the sucking port, without having turbulent flow, and thus it becomes possible to easily collect contaminants, too. Furthermore, it may be possible to reduce the volume of the major tank and thus the total amount of the liquid material by the provision of the narrowed portion 12, as compared with a major tank that is rectangular in shape. The partition wall 11 has an upper end 11*a* that serves as a weir for controlling the overflow of the liquid material from the major tank 1 into the minor tank T. A circulatory mechanism 2 of the electrodeposition coating system comprises a sucking port 13, disposed at the downstream end of the major tank, and another sucking port (no numeral), disposed at the bottom of the minor tank T. The liquid material of the major and minor tanks is sucked out thereof by a pump P (e.g., a centrifugal, rotary, or reciprocating pump), then is passed through a filter F for filtering contaminants out of the liquid material, then is passed through a heat exchanger B for adjusting the temperature of the liquid material, and then is discharged into the major tank 1 from discharge nozzles 21 through transverse pipes 22, as shown in FIGS. 5–6. In fact, as shown in FIG. 6, a fluid conduit (no numeral) of the circulatory mechanism 2 for circulating the liquid material through the major tank 1 is divided into the transverse pipes 22 each having a plurality of nozzles 21. Each nozzle is adjusted to direct the flow therefrom in a direction as shown by an arrow of FIG. 5 such that the majority of the flow of the liquid material is in one direction that is substantially along the longitudinal direction of the major tank 1. In fact, as shown in FIG. 5, the nozzles 22 of the introductory region of the major tank 1 may be adjusted to make the surface layer's flow in a horizontal direction, and those of the middle and exit regions of the major tank 1 may be adjusted to make the bottom layer's flow in a horizontal direction. It is preferable that the nozzles 21 of the middle and exit regions are adjusted to discharge the liquid material in somewhat downward directions, as shown by arrows of FIG. 5, in order to sufficiently disperse the paint particles which tend to precipitate on the bottom wall of the major tank 1. The circulatory mechanism may have at least one discharge rate regulatory valve (not shown) for regulating the discharge rate of the nozzle(s) 21. One discharge rate regulatory valve may be installed on at least one nozzle 21 or pipe 22. Although not shown in FIGS. 5–6, it is needless to say that the circulatory mechanism 2 may have two separate fluid conduits, each equipped with a pump, a filter and a heat exchanger. In this case, one fluid conduit serves to return the liquid material from the minor tank to the major tank, and the other conduit serves to circulate the liquid material through the major tank, without using the minor tank.

Figure 7:
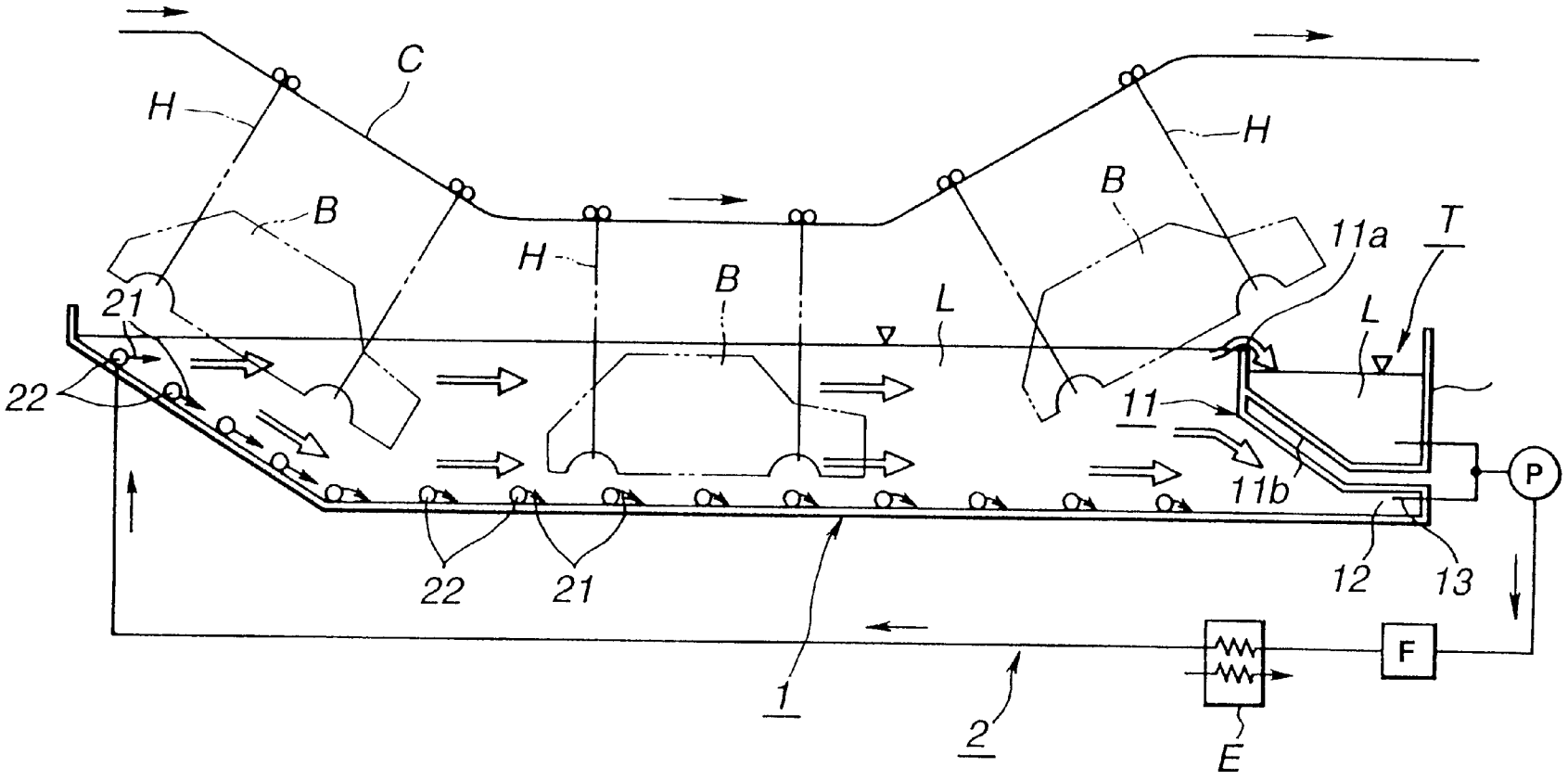

An electrodeposition coating system according to the sixth embodiment of the present invention will be described as follows. This system is a slight modification of that of the fifth embodiment, and therefore the same descriptions as those of the fifth embodiment will not be repeated in the following. As is seen from FIG. 7, the major tank 1 is formed at its downstream end with a partition wall 11 having an inclined surface 11*b*. The system has a minor tank T having a horizontal bottom wall and an inclined wall, which are spaced from the partition wall 11, as illustrated. It is possible to obtain the same advantages of the fifth embodiment of the invention.

Figure 8:
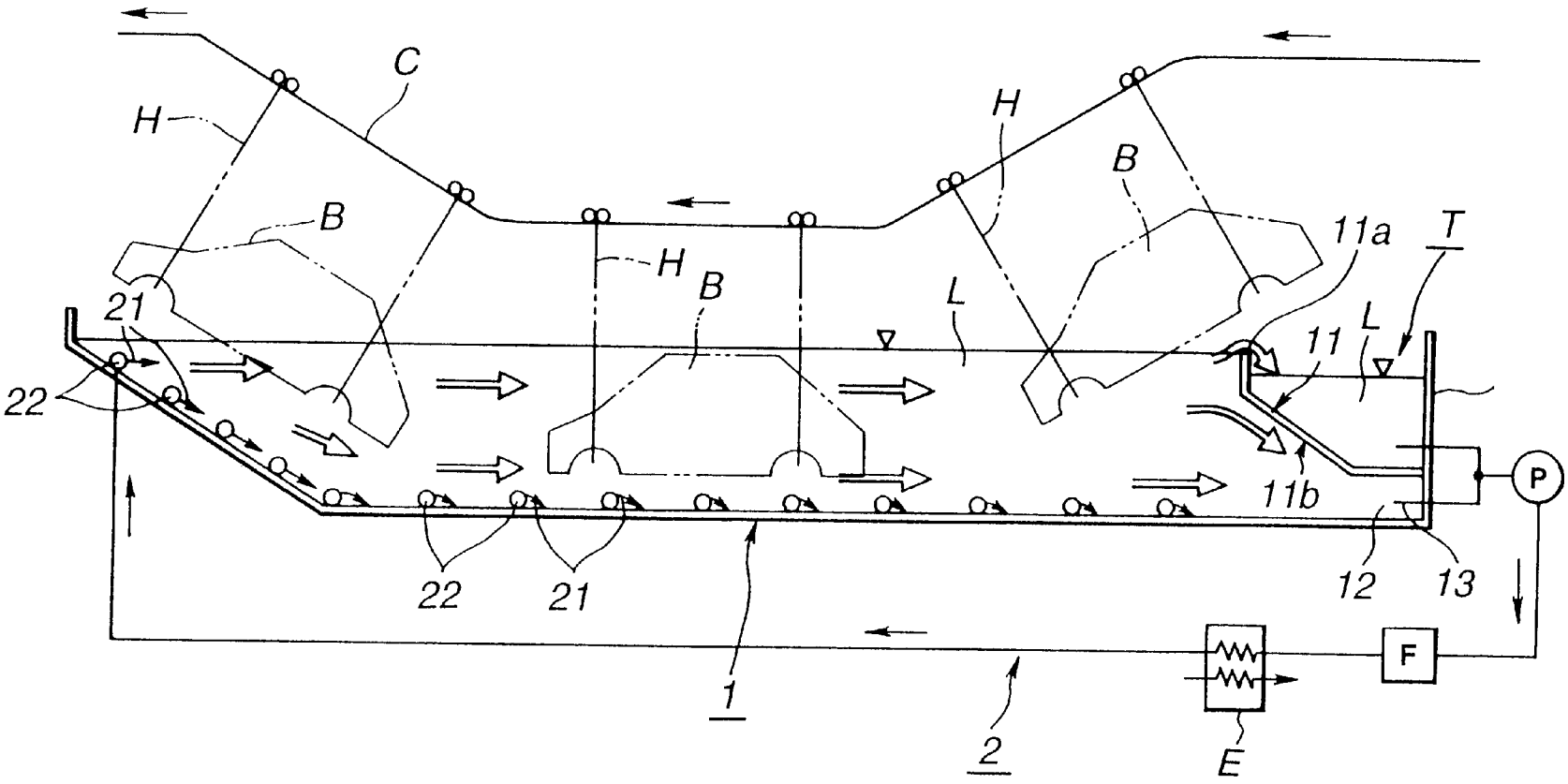

An electrodeposition coating system according to the seventh embodiment of the present invention will be described as follows. This system is a slight modification of that of the fifth embodiment, and therefore the same descriptions as those of the fifth embodiment will not be repeated in the following. As is seen from FIG. 8, the majority of the liquid material's flow is in one direction that is opposite to a direction along which the work is moved in the major tank 1. Although not shown in FIG. 8, there is provided another minor tank that is adjacent to the exit region of the major tank 1, for receiving an overflow of the liquid material when the work is withdrawn from the major tank 1. It is possible to obtain the same advantages of the fifth embodiment of the invention. Furthermore, it becomes possible to increase the relative flow speed of the liquid material relative to the work moving in the major tank 1, as compared with the system according to the fifth embodiment of the invention. With this, it becomes possible to efficiently remove contaminants from the major tank and bubbles and heat from the surface of the work.

What is claimed is:

1. A system for treating a surface of an article with a liquid material by dipping, said system comprising:

(a) a major tank having therein said liquid material for dipping said article thereinto; and (b) a circulatory mechanism for circulating said liquid material through said major tank, said circulatory mechanism comprising:

(1) a minor tank connected with said major tank, said minor tank receiving an overflow of said liquid material from said major tank; and (2) means for sucking said liquid material out of said major tank, wherein said circulatory mechanism is arranged to establish a first flow of liquid material through said major tank such that a first contaminant introduced into said major tank by said article, is carried from said major tank to said minor tank and to establish a second flow of liquid material that carries a second contaminant, which has been introduced into said major tank by said article, to a sucking port where the second liquid flow containing the second contaminant is at least in part sucked out of said major tank by said sucking means.

2. A system according to claim 1, which is an electrodeposition coating system for applying said liquid material to said article by dipping.

3. A system according to claim 1, wherein the first and second flows of said liquid material move in essentially a common direction that is substantially a longitudinal direction of said major tank and from an upstream side to a downstream side of said major tank.

4. A system according to claim 3, wherein said minor tank adjacent said downstream side of said major tank such that said minor tank receives the first contaminant in the overflow of said liquid material.

5. A system according to claim 3, wherein said sucking port is positioned on said downstream side of said major tank.

6. A system according to claim 5, wherein said circulatory mechanism further comprises at least one discharge port for discharging contaminant free liquid material said at least one discharge port being positioned on said upstream side of said major tank and is directed toward said downstream side of said major tank.

7. A system according to claim 6, wherein said circulatory mechanism further comprises a drive device for driving said liquid material through at least one fluid conduit, and a filter for filtering the first and second contaminants out of said liquid material.

8. A system according to claim 1, wherein said second flow is lower than said first flow in position, wherein, until said first and second flows reach a downstream end of said major tank, said first and second flows run substantially in parallel with each other, and wherein said major tank is formed at said downstream end with a wall having configuration such that said first and second flows are separated from each other at said downstream end and causes the first flow to overflow into said minor tank and the second flow to move towards said sucking port, respectively.

9. A system for treating a surface of an article with a liquid material by dipping, said system comprising:

(a) a major tank having therein said liquid material for dipping said article thereinto; and (b) a circulatory mechanism for circulating said liquid material through said major tank, said circulatory mechanism being arranged to produce a plurality of essentially concurrent flows which move from a first end of said major tank toward a second end of the major tank and wherein one of the concurrent flows tends to flow along the lower surface of the major tank while the another of the concurrent flows tends to move along one of the upper and mid-portions of said major tank.

10. A system according to claim 9, which is an electrodeposition coating system for applying said liquid material to said article by dipping.

11. A system according to claim 9, wherein said major tank comprises (1) an introductory region into which said article is introduced and (2) an exit region from which said article is withdrawn, and wherein said circulatory mechanism comprises a minor tank that is adjacent to said introductory region of said major tank, said minor tank receiving an overflow of said liquid material from said introductory region of said major tank.

12. A system according to claim 11, wherein said circulatory mechanism further comprises another minor tank that is adjacent to said exit region of said major tank, said another minor tank receiving an overflow of said liquid material from said exit region of said major tank.

13. A system according to claim 12, wherein said circulator y mechanism comprises a fluid conduit for circulating said liquid material through said major tank, said fluid conduit having a discharge port disposed in a vicinity of said another minor tank, said discharge port discharging said liquid material, which has been filtered by a filter, in a direction that is opposite to a direction in which the plurality of essentially concurrent flows move.

14. A system according to claim 13 wherein said discharge port discharges said liquid material in a direction towards said another minor tank.

15. A system according to claim 11, wherein said circulatory mechanism further comprises another minor tank that is adjacent to said exit region of said major tank, said another minor tank receiving said liquid material that was rinsed out of said article after said liquid material was applied to said article in said major tank.

16. A system according to claim 15, wherein said circulatory mechanism further comprises a fluid conduit for returning said liquid material from said another minor tank to said major tank.

17. A system according to claim 11, wherein the plurality of essentially concurrent flows comprises a first flow of said liquid material in said major tank and a second flow that is lower than said first flow in position, wherein, before said first and second flows reach a downstream end thereof in said major tank, said first and second flows run substantially in parallel with each other, and wherein said major tank is formed at said downstream end with a wall having a configuration such that said first and second flows are separated from each other and are respectively caused to flow toward the minor tank and to overflow thereinto, and to move towards means for sucking said liquid material out of said major tank.

18. A system according to claim 9, wherein the plurality of concurrent flows move in a direction is opposite to a direction along which said article is moved in said major tank.

19. A system according to claim 9, wherein a majority said liquid material flows at a speed of 10–25 cm/s relative to said article.

20. A system according to claim 9, wherein said circulatory mechanism comprises:

a minor tank connected with said major tank, said minor tank receiving an overflow of said liquid material from said major tank;

a sucking port for sucking said liquid material out of said minor tank;

a drive device for driving said liquid material through a fluid conduit which interconnects the major and minor tanks;

a filter for filtering contaminants out of said liquid material in the fluid conduit; and a discharge port for discharging said liquid material, which has been filtered by said filter, into said major tank.

21. A system according to claim 20, wherein said major tank ha bottom, front, back and side wall surfaces, and wherein the fluid conduit is divided into a plurality of branches respectively having nozzles for discharging said liquid material into said major tank, said nozzles being disposed in an exit region of said major tank and/or along at least one surface selected from the group consisting of said bottom, front, back, and side wall surfaces of said major tank, said exit region of said major tank being a region from which said article is withdrawn.

22. A system according to claim 21, wherein each nozzle has a flow regulator for regulating a discharge rate of said liquid material.

23. A system according to claim 22, wherein said nozzles are disposed along and away from and directed to said at least one surface of said major tanks.

24. A system according to claim 9, wherein said circulatory mechanism further comprises:

a sucking port for sucking liquid material out of said major tank;

a drive device for driving said liquid material through a fluid conduit connected with said major tank;

a filter for filtering contaminants out of liquid material in the liquid conduit; and a discharge port for discharging said liquid material, which has bee filtered by said filter, into said major tank.

25. A method for treating a surface of an article with a liquid material by dipping using a system, said system comprising (a) a major tank having therein said liquid material for dipping said article thereinto; and (b) a circulatory mechanism for circulating said liquid material through said major tank, said circulatory mechanism comprising (1) a minor tank connected with said major tank, said minor tank receiving an overflow of said liquid material from said major tank; and (2) means for sucking said liquid material out of said major tank, said method comprising the step of:

establishing a flow pattern in said liquid material in said major tank by arranging said circulatory mechanism, while said article is dipped in said liquid material to treat said surface of said article with said liquid material, such that a first contaminant, which has been introduced into said major tank by said article, is transferred from said major tank to said minor tank by the overflow of a first flow portion of said liquid material into the minor tank and that a second contaminant, which has been introduced into said major tank by said article, is removed from said major tank in a second flow portion of liquid material which is sucked out of said major tank by said sucking means.

26. A method according to claim 25, wherein said system is an electrodeposition coating system for applying said liquid material to said article by dipping.

27. A method for treating a surface of an article with a liquid material by dipping the article in the liquid material using a system comprising (a) a major tank having therein said liquid material; and (b) a circulatory mechanism for circulating said liquid material through said major tank, said method comprising the step of:

establishing a flow pattern in said liquid material in said major tank by producing, using said circulatory mechanism, at least two separate and essentially concurrent flows of said liquid material which move essentially in the same direction along a longitudinal direction of said major tank.

28. A method according to claim 27, wherein said system is an electrodeposition coating system for applying said liquid material to said article by dipping.

29. A method according to claim 27, wherein said major tank comprises (1) an introductory region into which said article is introduced and (2) an exit region from which said article is withdrawn, wherein said circulatory mechanism comprises a minor tank that is adjacent to said introductory region of said major tank, and wherein said method further comprises the step of allowing said minor tank to receive an overflow of said liquid material from said introductory region of said major tank.

30. A method according to claim 29, wherein said circulatory mechanism further comprises another minor tank that is adjacent to said exit region of said major tank, and wherein said method further comprises the step of allowing said another minor tank to receive an overflow of said liquid material from said exit region of said major tank.

31. A method according to claim 30, further comprising the step of introducing into said another minor tank liquid material rinsed from said article after said article is removed from said major tank.

32. A method according to claim 31, wherein said circulatory mechanism further comprises a fluid conduit for returning said liquid material from said another minor tank to said major tank.

33. A method according to claim 30, wherein said circulatory mechanism comprises a fluid conduit for circulating said liquid material through said major tank, and wherein said method further comprises the step of discharging said liquid material, which has been filtered by a filter, from a discharge port of said fluid conduit, in a direction that is opposite to that in which the at least two separate and essentially concurrent flows move, said discharge port being disposed close to said another minor tank.

34. A method according to claim 33, further comprising the step of discharging said liquid material from said discharge port in a direction towards said another minor tank.

35. A method according to claim 27, wherein the at least two separate and essentially concurrent flows move in an essentially common direction which is opposite to a direction along which said article is moved in said major tank.

36. A method according to claim 27, wherein the flow pattern of said liquid material is such that the liquid moves at a speed of 10–25 cm/s relative to said article.

37. A method according to claim 27, further comprising the steps of:

(a) allowing a minor tank connected with said major tank to receive a n overflow of said liquid material from said major tank;

(b) sucking said liquid material out of said minor tank into a fluid conduct connected with said major and minor tanks using a drive device;

(c) driving said liquid material through said fluid conduit using said drive device;

(d) filtering contaminants out of said liquid material by a filter during the step (c); and (e) discharging said liquid material, which has been filtered in the step (d), into said major tank from a discharge port of said fluid conduit, thereby to make said overflow of the step (a).

38. A method according to claim 37, wherein said major tank has bottom, front, back and side wall surfaces, and wherein said fluid conduit is divided into a plurality of branches respectively having nozzles for discharging said liquid material into said major tank, said nozzles being disposed in an exit region of said major tank and/or along at least one surface selected from the group consisting of said bottom, front, back, and side wall surfaces of said major tank, said exit region of said major tank being a region from which said article is withdrawn.

39. A method according to claim 38, wherein each nozzle has a flow regulator for regulating a discharge rate of said liquid material.

40. A method according to claim 38, wherein said nozzles are disposed along and away from and directed to said at least one surface of said major tank.

41. A method according to claim 27, further comprising the steps of:

(a) sucking said liquid material out of said major tank into a fluid conduit connected with said major tank using a drive device;

(b) driving said liquid material through said fluid conduit using said drive device;

(c) filtering contaminants out of said liquid material using a filter during the step (b); and (d) discharging said liquid material, which has been filtered in the step (c), into said major tank from a discharge port which fluidly communicates with said fluid conduit.

42. A system for treating a surface of an article by dipping the article in a liquid material, said system comprising:

a major tank having therein said liquid material for dipping said article thereinto; and means for removing first and second different contaminants from the liquid material, comprising:

a circulatory mechanism for circulating said liquid material through said major tank, said circulatory mechanism comprising:

(1) a minor tank connected with said major tank, said minor tank receiving an overflow of said liquid material from said major tank; and (2) means for sucking said liquid material out of said major tank, wherein said circulatory mechanism is arranged to establish a first flow of said liquid material through said major tank such that the first contaminant, which has been introduced into said major tank by said article, is carried by the first flow from said major tank to said minor tank via said overflow of liquid material and is further arranged to establish a second flow which carries the second contaminant, which has been introduced into said major tank by said article, to slid sucking means, wherein the first flow of said liquid material is located above the second flow, wherein, until said first and second flows reach a downstream end of said major tank, said first and second flows run substantially in parallel with each other, and wherein said major tank is formed at said downstream end thereof with a wall having a configuration such that said first and second flows are separated from each other at said downstream end and are directed toward the minor tank and said sucking means, respectively.

43. A system according to claim 42, wherein said minor tank is adjacent to said downstream end of said flow in said major tank, and wherein said wall is a partition between said major and minor tanks.

44. A system according to claim 42, wherein said sucking means comprises a sucking port for sucking said liquid material out of said major tank, said sucking port being disposed at the downstream end of said major tank.

45. A system according to claim 44, wherein said circulatory mechanism further comprises (1) a first fluid conduit for returning said liquid material from said minor tank to an upstream side of said major tank and (2) a second fluid conduit returning said liquid material from said sucking port to said upstream side of said major tank.

46. A system according to claim 45, wherein said circulatory mechanism further comprises a filter for filtering contaminants out of liquid material in the first and second fluid conduits.

47. A system according to claim 42, wherein said wall has an inclination such that said second flow is made to move towards said sucking means.

48. A system according to claim 42, wherein said major tank s narrowed at said downstream end of said flow such that the second flow converges substantially at said sucking means.

49. A system according to claim 42, wherein the first and second flows of liquid material move in a common direction that is opposite to a direction in which said article is moved in said major tank.

50. A method for treating a surface of an article with a liquid material by dipping using a system, said system comprising (a) a major tank having therein said liquid material for dipping said article thereinto; and (b) a circulatory mechanism for circulating said liquid material through said major tank, said circulatory mechanism comprising (1) a minor tank connected with said major tank, said min)r tank receiving an overflow of said liquid material from said major tank; and (2) means for sucking said liquid material out of said major tank, said method comprising the steps of:

(a) making a flow of said liquid material through said major tank using said circulatory mechanism, while said article is dipped in said liquid material to treat said surface of said article with said liquid material, such that a first contaminant, which has been introduced into said major tank by said article, is removed from said major tank to said minor tank by said overflow of said liquid material and such that a second contaminant, which is different from the first contaminant and has been introduced into said major tank by said article, is sucked out of said major tank by said sucking means, said flow of said liquid material comprising a first flow and a second flow, the second flow being is lower than said first flow in position, (b) making said first and second flows run substantially in parallel with each other before said first and second flows reach a downstream end thereof in said major tank; and (c) separating said first and second flows from each other at said downstream end using a wall of said major tank at said downstream end, thereby to respectively direct said first and second flows to said overflow and towards said sucking means.

51. A method according to claim 50, wherein said sucking means comprises a sucking port for sucking said liquid material out of said major tank, and wherein said liquid material that was sucked out of said major tank is filtered to remove contaminants therefrom and is then returned to said major tank.

52. A method according to claim 50, wherein said liquid material of said minor tank is sucked out of said minor tank, then filtered to remove contaminants therefrom and then returned to said major tank.

53. A method according to claim 50, wherein a flow direction of the first and second flows is opposite to a direction in which said article is moved in said major tank.

* * * * *